United States Patent [19]

Caldwell

[11] 4,112,909

[45] Sep. 12, 1978

[54] COMPOUND BOW

[75] Inventor: Joseph M. Caldwell, Tujunga, Calif.

[73] Assignee: Jennings Compound Bow, Inc., Valencia, Calif.

[21] Appl. No.: 793,089

[22] Filed: May 2, 1977

Related U.S. Application Data

[63] Continuation of Ser. No. 582,717, Jun. 2, 1975, abandoned.

[51] Int. Cl.[2] ..... F41B 5/00

[52] U.S. Cl. ..... 124/23 R; 124/90

[58] Field of Search ..... 124/24 R, 23 R, 86, 124/90, 88, 41 A

[56] References Cited

U.S. PATENT DOCUMENTS

| | | | |
|---|---|---|---|
| 3,854,467 | 12/1974 | Hofmeister | 124/24 R |
| 3,990,425 | 11/1976 | Ketchum | 124/90 |

*Primary Examiner*—William R. Browne

*Attorney, Agent, or Firm*—Ellsworth R. Roston

[57] ABSTRACT

A compound bow having a center handle portion, upper and lower limbs having inner ends connected to the handle portion, and upper and lower draw pulleys mounted on the free outer ends of the upper and lower limbs. Each of the draw pulleys has a peripheral portion, a central portion, and first and second spaced grooves in the peripheral portion. A passage in each draw pulley leads through its central portion and connects the first and second grooves.

Each pulley has an inner surface portion and an outer surface portion on the peripheral portion with the inner surface portion facing the bow and the outer surface portion being directed away from the bow when the bow is in its rest position. A pivotal mounting is provided for each pulley with the pulleys being eccentrically positioned on the mountings for rotational movement during draw of the bow with the bowstring supported by the pulleys. Rotational movement of the pulleys increases the effective length of each of the bow limbs. Due to the structure and positioning of the pulleys and the manner in which the pulleys are supported by draw cables, the force required to draw the bow increases rapidly when the bow reaches its fully drawn position so that it is virtually impossible to overdraw the bow.

26 Claims, 7 Drawing Figures

COMPOUND BOW

This is a continuation of application Ser. No. 582,717, filed June 2, 1975, now abandoned.

BACKGROUND OF THE INVENTION

Compound bows are a relatively recent innovation to the field of archery. However, due to their many advantages over conventional archery bows, the use of compound bows has increased and compound bows have been gaining rapidly in popularity.

In a conventional bow, the force required to draw the bow is determined by the bow stiffness and the draw force increases in a relatively uniform manner as the bow is drawn. The fact that the force required to draw the bow increases uniformly imposes limitations on the use of the bow which may limit its usage. By way of example, if the bow requires a draw force of 80 pounds, the archer must be able to, not only draw the bow, but to then hold the bow in a steady position during sighting and discharge of an arrow. While the archer may be able to draw a relatively heavy bow, he may not be able to hold the bow in a steady position during sighting and release of an arrow while maintaining the force on the bow necessary to keep it in its drawn condition.

In a compound bow, the draw force does not increase in a uniform manner as the bow is drawn. Through the use of eccentrically mounted pulleys positioned at the ends of the bow limbs, the effective length of the bow limbs is increased during draw of the bow through rotation of the eccentrically mounted pulleys. On rotation of the eccentrically mounted pulleys, the force required to maintain the bow in a drawn condition is decreased with the result that the force required to maintain the bow in a drawn condition during sighting and release of an arrow is less than the maximum force required in drawing the bow. In the case of a bow having a draw weight, for example, of 65 pounds, the maximum force required in drawing the bow is 65 pounds. However, near the end of the draw, there is a let off, e.g., of 10 to 15 pounds depending on the size and the eccentricity of the draw pulleys, with the result that the bow can then be held in a steady position during sighting and release of an arrow with a force of only 50–55 pounds. As the arrow is discharged, the draw pulleys undergo rotational movement which is opposite to the rotational movement that occurs during draw. With the reverse rotational movement of the draw pulleys, the force that is applied to the arrow by the bow is increased with the result that the arrow is discharged under a propulsive force that is higher than the force required to hold the bow during sighting and discharge of an arrow.

The energy which is stored in an archery bow during draw may be determined by integrating the area under the force-draw curve of the bow. In the case of a standard bow, the force-draw curve is a straight line in which, with the draw force plotted vertically and the draw distance plotted horizontally, the force increases uniformly as the bow is drawn with the draw force increasing to a maximum when the bow is fully drawn. However, in a compound bow, the force-draw curve is not a straight line but, rather, is a curve in which the draw force increases rapidly until a maximum is reached with the draw force then decreasing due to let off resulting from rotation of the eccentrically mounted draw pulleys. U.S. Pat. No. 3,486,495 to Allen contains an extensive description of a compound bow and the way in which a compound bow functions. As presented in the Allen patent, the stored energy represented by the area under the force-draw curve of a compound bow is greater than the amount of stored energy for an equivalent standard bow having the same draw length. Thus, another advantage of compound bows is the fact that they are more efficient in storing energy during draw of the bow. To store the same amount of energy with a standard bow, it would, thus, be necessary to use a bow with a greater draw length than that of an equivalent compound bow.

One problem area in the use of compound bows involves the accidental breakage of the bow by an overly enthusiastic archer. The mechanical advantage which is provided in a compound bow by the use of draw cables and draw pulleys permits the archer to continue the application of force to the bow after the bow has been drawn to its full draw length. The bow limbs of a compound bow are generally relatively short and stiff as compared with the limbs of a standard bow. The shorter and stiffer limbs are more susceptible to breakage and are more easily overstressed through the usage of multiple draw cables and draw pulleys which gives the archer a mechanical advantage in bending the bow limbs.

In view of the possiblity of limb breakage which is present in the use of compound bows, it would be desirable if a compound bow could be provided in which the mechanical advantage provided to the archer would be largely lost as soon as the bow was drawn to its full draw length. With such a compound bow, it would then be very difficult, if not impossible, for the archer to accidentally break a bow limb by overdrawing the bow.

SUMMARY OF THE INVENTION

In providing a solution to the aforementioned problem, I have provided a compound bow in which the force required to draw the bow increases abruptly when the bow reaches full draw. As a result, it is almost impossible to overdraw the bow.

Additionally, the bow of the invention is relatively simple in its construction and does not require adjustment by the archer as is required with many compound bows. In the present bow, the draw weight and draw length are determined by the manufacturer who sets the draw weight and draw length for the life of the bow. The present bow does not require adjustment by the archer and is almost impossible to overdraw; thus, providing a very simple and very reliable bow construction.

The present compound bow includes a center handle portion, upper and lower limbs having their inner ends connected to the handle portion, and upper and lower draw pulleys which are mounted respectively on the free outer ends of the upper and lower limbs. Each of the draw pulleys has a peripheral portion, a central portion, first and second spaced grooves in the peripheral portion, and a passage which leads through the central portion of the pulley in connecting the first and second grooves.

Each draw pulley has an inner surface portion and an outer surface portion which are defined on the peripheral portion of the pulley. With the bow in its rest position, the inner surface portion of the pulley faces the bow while the outer surface portion of the pulley is directed away from the bow. A pivotal mounting is provided for each pulley with the pulleys being eccentrically positioned for rotational movement with respect to the mountings during draw of the bow. Each of the mountings is positioned relative to one of the pulleys on a line which passes through the approximate geometric center of the pulley with the position of the mounting dividing the line into a shorter segment and a longer segment. With the bow in its rest position, each of the draw pulleys is positioned with the longer line segment of the pulley directed toward the inner end of the bow limb that supports the pulley. At the same time, the shorter line segment is directed toward the outer end of the supporting bow limb.

During draw of the bow, the draw pulleys each undergo rotation to a position in which the longer line segment is directed toward the outer end of the bow limb while the shorter line segment is directed toward the inner end of the supporting bow limb. This rotation results in effectively increasing the length of the bow limbs such that a smaller draw force is required to maintain the bow in its drawn position.

A first draw cable having one end secured to the lower bow limb has a free end which passes into contact with the inner surface portion of the first groove on the upper draw pulley with the bow in its rest position. The free end of the draw cable then passes through the passage in the upper pulley into the second grooves and passes over the inner surface portion of the second groove into contact with the outer surface portion of the second groove. Similarly, a second draw cable has one end secured to the upper bow limb and has a free end which passes into contact with the inner surface portion of the first groove on the lower draw pulley with the bow in its rest position. The free end of the second draw cable then passes through the passage in the lower pulley into the second groove and passes over the inner surface portion of the second groove and into contact with the outer surface portion of the second groove. The free ends of the two draw cables are then interconnected by a bowstring with the bowstring, thus, being supported by the draw cables and draw pulleys.

In the present compound bow, each draw pulley is preferably circular with the pivotal mountings for the pulleys, thus, being positioned on a diameter of the pulley. Preferably, the second groove of each draw pulley has a greater length than the first groove. This provides the archer with an additional mechanical advantage in drawing the bow that is proportional to the ratio of the length of the second groove with respect to the length of the first groove. Also, the passage in each pulley which inteconnects the first and second grooves preferably passes through the approximate geometrical center of the pulley. Additionally, the passage in each draw pulley is preferably positioned at approximately a right angle with respect to the line which passes through the pivotal mounting for the pulley and the approximate geometrical center of the pulley.

DESCRIPTION OF THE DRAWINGS

In illustrating a preferred embodiment of the compound bow of the invention, reference is made to the accompanying drawings in which.

DETAILED DESCRIPTION

Figure 1:
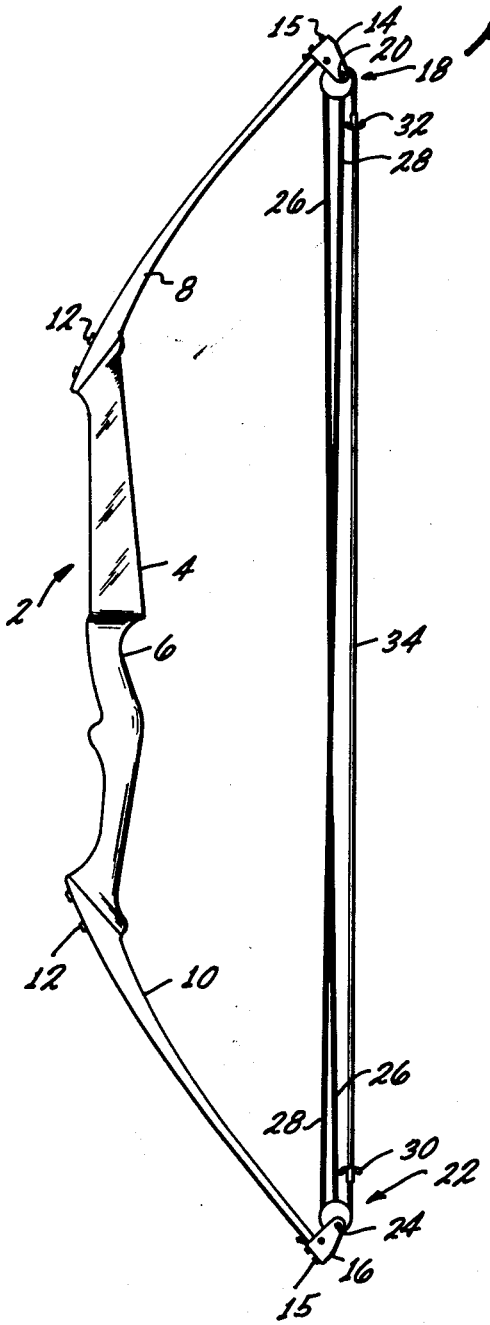
FIG. 1 is a side elevational view of a compound bow of the invention.

As shown in front elevational view in FIG. 1, a compound bow 2 includes a center section 4 having a handle 6 with an upper limb 8 and a lower limb 10 being joined to the center section by any suitable means such as screws 12. An upper pulley bracket 14 is connected to the outer end of upper limb 8 by any suitable means such as screws 15 while a lower pulley bracket 16 is connected in similar manner to the lower limb 10. An upper draw pulley, indicated generally as 18, is connected to upper bracket 14 through a pivotal mounting 20 while a lower draw pulley, indicated generally as 22, is connected to lower bracket 16 through a pivotal mounting 24.

A draw cable 26 having one end connected to the lower bracket 16 passes over the upper draw pulley 18 in a manner to be described while a draw cable 28 having one end connected to the upper bracket 14 passes over the lower draw pulley 22 in a similar manner. A bowstring holder 30 is connected to the free outer end of draw cable 28 while a bowstring holder 32 is connected to the free outer end of draw cable 26. A bowstring 34 has its ends connected to the bow string holders 30 and 32 with the bow string, thus, being supported by the draw cables 26 and 28 and the draw pulleys 18 and 22.

Figure 2:
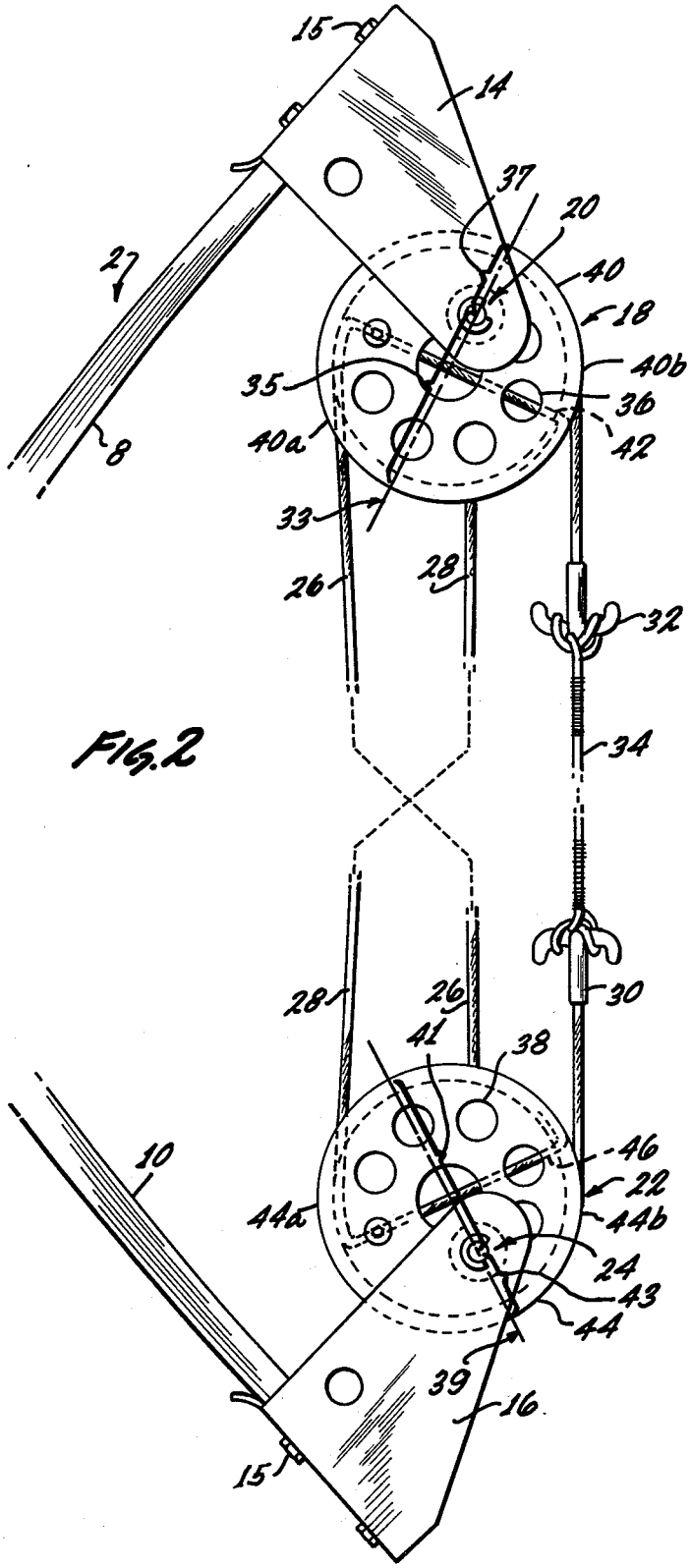
FIG. 2 is a partial side elevation view of the bow illustrating the positioning of draw cables on eccentrically mounted draw pulleys with the bow in its rest position.

FIG. 2 is an enlarged partial front elevational view of the compound bow 2 which illustrates the positioning of draw cables 26 and 28 with respect to draw pulleys 18 and 22 when the bow is in its rest position. With reference to upper draw pulley 18, a major line generally indicated as 33 passes through the center of pivotal mounting 20 and also through the approximate geometrical center of the pulley. The major line 33 is divided into a larger line segment 35 and a smaller line segment 37 by the position of pivotal mounting 20 on the major line.

The lower draw pulley 22 also includes a major line generally indicated as 39, which is divided into a larger line segment 41 and a smaller line segment 43 by the position of pivotal mounting 24 on the major line. With the bow in its rest position, the larger line segment 35 of upper draw pulley 18 and also the larger line segment 41 of lower draw pulley 22 are directed generally inwardly toward the inner ends of bow limbs 8 and 10.

The upper draw pulley 18 has a peripheral surface 40 that is contacted by the draw cable 26 with the peripheral surface including an inner surface portion 40*a* that is directed toward the bow 2 and an outer surface portion 40*b* that is directed away from the bow in its rest position. A passage 42, which will be described in detail hereafter, passes through the central portion of draw pulley 18 and, as illustrated, the passage may be positioned generally perpendicular to the major line 33.

The lower draw pulley 22 also includes a peripheral surface 44 which is contacted by the draw cable 28 with the peripheral surface including an inner surface portion 44*a* directed toward the bow 2 and an outer surface portion 44*b* directed away from the bow with the bow in its rest position. The lower draw pulley 22 also includes a passage 46 through the central portion of the pulley which may be positioned generally perpendicular to the major line 39.

Figure 3:
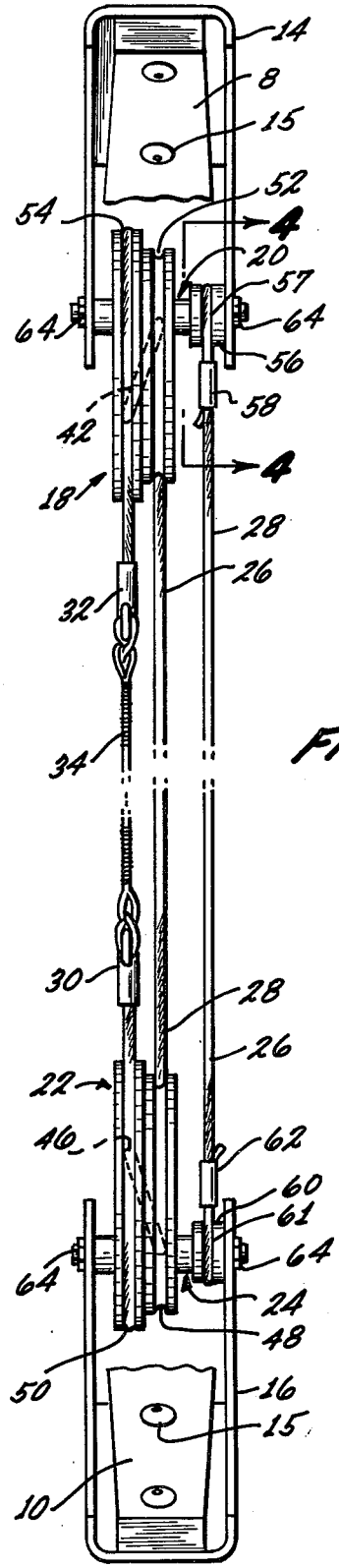
FIG. 3 is an end elevational view of the compound bow illustrated in FIG. 2.

Turning to FIG. 3, which is an end elevational view of the structure shown in FIG. 2, the lower draw pulley 22 includes a smaller groove 48 and a larger groove 50 formed on the peripheral pulley surface 44. Also, the upper draw pulley 18 includes a smaller groove 52 and a larger groove 54 formed on the peripheral surface 40. With reference to both FIGS. 2 and 3, the free end of the draw cable 26 leads into the smaller groove 52 and contacts the inner surface portion 40*a* of the peripheral surface 40. The free end of draw cable 26 then passes through the passage 42 into the larger groove 54 with the draw cable then passing again into contact with the inner surface portion 40*a* of peripheral surface 40 while contained within the larger groove. After passing almost completely about the peripheral surface 40 within the larger groove 54, the draw cable 26 then contacts the outer surface portion 40*b* with the free outer end of the draw cable connected to the bowstring 34 through bowstring holder 32 which is connected to the free outer end of the draw cable.

The free end of draw cable 28 passes into contact with the inner surface portion 44*a* of peripheral surface 44 while being retained within the smaller groove 48. The free end of the draw cable 28 then passes through passage 48 into the larger groove 50 with the draw cable again passing over the inner portion surface 44*a* while being retained within the larger groove. After passing almost completely around the peripheral surface 44 while contained within the larger groove 50, the draw cable 28 contacts the front surface portion 44*b* with the free end of the cable being connected to the bowstring 34 through bowstring holder 30.

By using spaced grooves such as 52 and 54 or 48 and 50 with one of the grooves having a greater length than the other groove, the archer is provided with a mechanical advantage during draw of the bow which is proportional to the length of the larger groove 50 or 54 with respect to the length of the smaller groove 48 or 52. During draw of the bow, as will be described, the draw cables 26 and 28 are unwound from larger grooves 50 and 54 while the draw cables are wound upon the smaller grooves 48 and 52 in transmitting a flexing force to the bow limbs 8 and 10.

The pivotal mounting 20 for upper draw pulley 18 includes a cable support sleeve 56 which supports an end loop 57 of the draw cable 28. The end loop 57 is formed through a ferrule 58 which secures the portions of the draw cable together that form the end loop.

Similarly, the pivotal mounting 24 for lower draw pulley 22 also includes a cable support sleeve 60 which supports an end loop 61 formed in the draw cable 26. The end loop 61 is formed by use of a ferrule 62 which connects the two cable portions together that form the end loop. Both of the pivotal mountings 20 and 24, as will be described, include a sleeve for rotatably supporting the draw pulley 18 or 22 with the sleeve being held with respect to bracket 14 or 16 by means of a bolt or similar member which passes through the sleeve and also through the arms of the bracket. Keeper members 64, such as nuts, may then be used to hold the mounting sleeves for pulleys 18 or 22 in a fixed position relative to the arms of the brackets 14 or 16.

Figure 4:
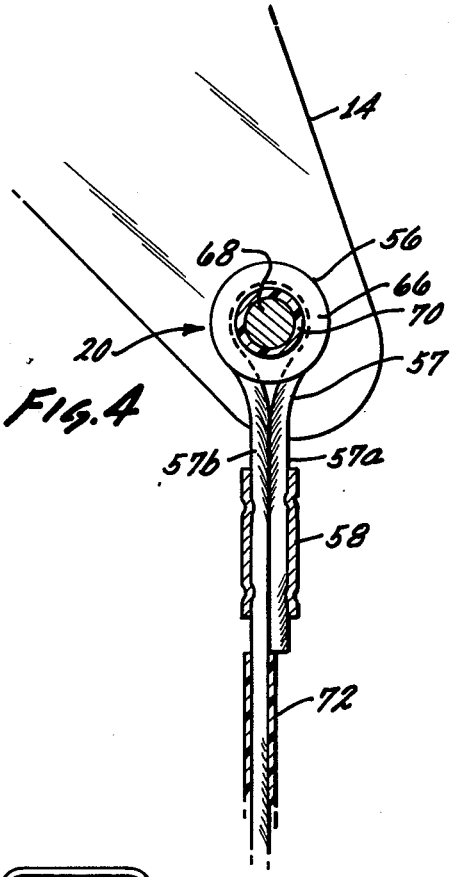
FIG. 4 is a sectional view taken along the line 4—4 of FIG. 3 which illustrates the manner in which the fixed end of the draw cable that leads to the lower draw pulley is mounted with respect to the upper bow limb.

Turning to FIG. 4, which is a sectional view taken along the line 4—4 of FIG. 3, the end loop 57 may be viewed as being formed of loop portions 57*a* and 57*b* with the two loop portions being held together by the ferrule 58. The end loop 57 may be positioned within a groove 66 in support sleeve 56 with the end loop being restrained from sideways movement with respect to the support sleeve. A shaft 68, which may be the shank of a bolt or similar connecting member, passes through a pulley support sleeve 70 which rotatably supports the upper pulley 18. As described, the ends of the shaft 68 pass through aligned apertures in the arms of bracket 14 with the ends of the shaft engaging keeper members 64 that bear against the exterior surfaces of the bracket to fix the position of the shaft with respect to the bracket. Similarly, the ends of the sleeve 70 may bear against the inner surfaces of the arms of the bracket 14 with the sleeve being thereby restrained against axial movement with respect to shaft 68. The upper draw pulley 18 may be rotatably supported with respect to the sleeve 70 through any suitable means to permit rotational movement of the upper pulley while preventing side movement of the pulley in an axial direction with respect to the sleeve 70. The construction of the pivotal mounting 24 for lower draw pulley 22 and also the functioning of support sleeve 60 with respect to end loop 61 may be the same as shown in FIG. 4 with respect to the pivotal mounting 20 for upper draw pulley 18, etc. The construction shown in FIG. 4, thus, has equal application to the pivotal mounting 24 for the lower draw pulley 22.

Figure 5:
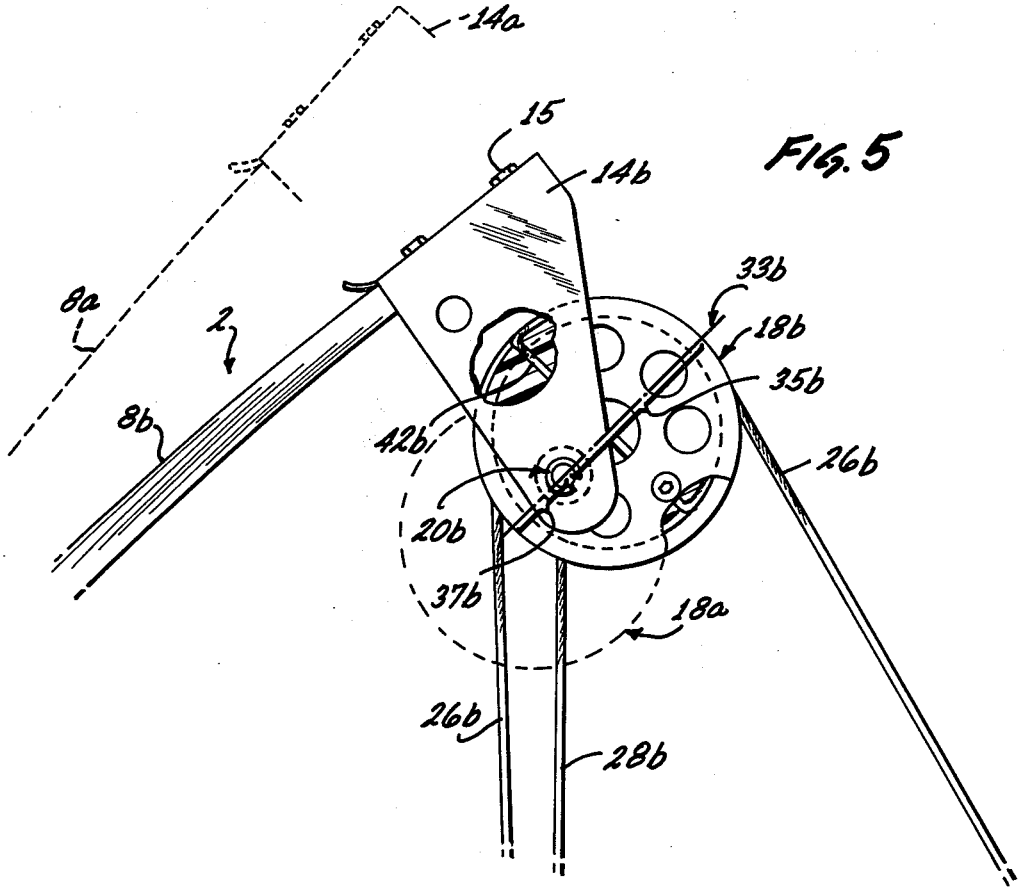
FIG. 5 is a partial side elevational view, similar to FIG. 2, illustrating the bending of the upper bow limb and the rotation of the upper draw pulley during draw of the bow.

FIG. 5, which is a partial front elevational view of the compound bow 2 illustrates the rotational position of the upper draw pulley 18 and the bending of the upper bow limb 8 during draw of the bow. As the bow 2 is drawn by exerting a draw force on the bowstring 34 (see FIGS. 1–3), the limbs 8 and 10 undergo bending. During the first portion of the draw, the draw cables 18 and 22 remain in their general position shown in FIG. 2. However, after the first portion of the draw, the draw pulleys 18 and 22 undergo rotational movement to increase the effective length of the bow limbs 8 and 10. With reference to FIG. 5, the upper bow limb has moved from a rest position 18*a* to a bent position 18*b* and the draw pulley 18 has undergone rotation from its rest position 18*a* to an extended position 18*b*. As a result of this rotation, the position of the major line 33 (see FIG. 2) has now been generally reversed. With the bow at rest, the larger line segment 35 of line 33 is generally directed toward the inner end of the bow limb 8 while the smaller line segment 37 is directed toward the outer end of the bow limb 8. However, after rotation of the upper draw pulley to its extended position 18*b*, the larger line segment 35*b* is directed toward the outer end of the upper bow limb while the smaller line segment 37*b* is directed toward the inner end of the upper bow limb. During the rotation of the upper draw pulley from the rest position 18*a* to the extended position 18*b*, the force required to move the bowstring 34 has increased to a maximum value.

Through rotation of the upper draw pulley from its rest position 18*a* to its extended position 18*b*, the length of the upper bow limb has, thus, been effectively increased by an amount which is approximately equal to the difference between the length of the larger line segment 35 and the smaller line segment 37. Continued rotation of the upper draw pulley beyond the extended position **18*b* provides a letoff in the force on the bowstring 34**. This letoff may range up to about 40 percent of the draw weight of the bow with the result that the archer can then hold a bow in a bent position more easily with the application of less force. This permits the archer to sight more accurately and to hold the bow more steady while releasing an arrow.

Figure 6:
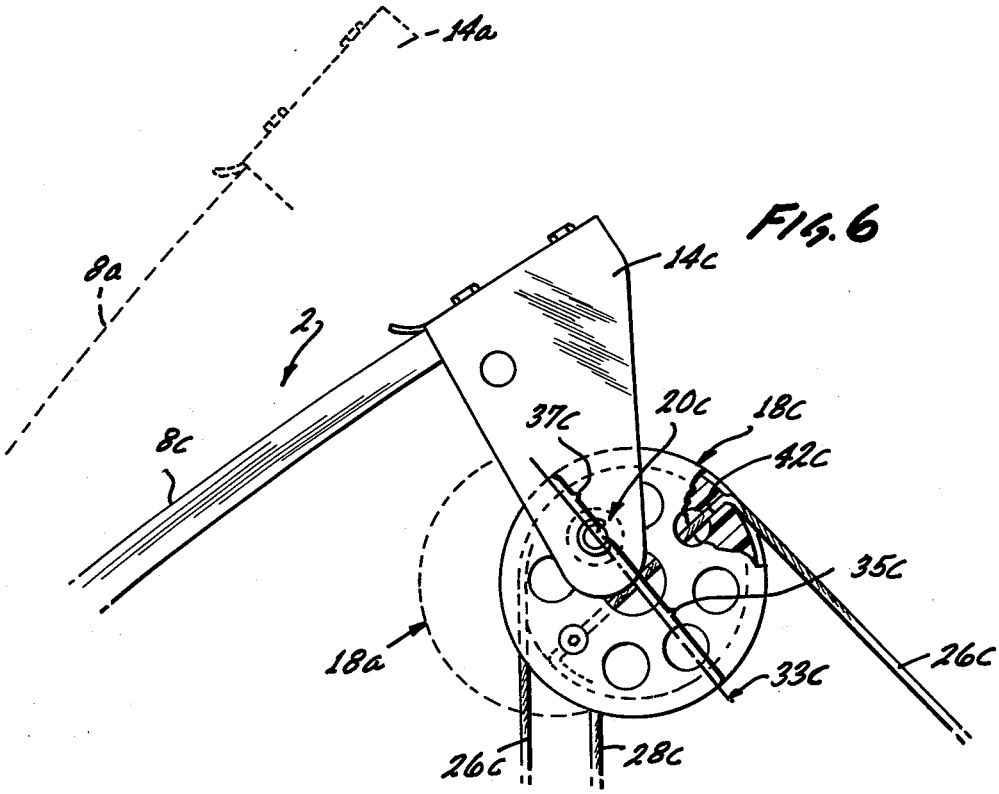
FIG. 6 is a partial side elevational view, similar to FIG. 5, illustrating bending of the upper bow limb and the rotational position of the upper draw pulley when the bow is in its fully drawn position.

FIG. 6, which is a partial front elevational view, similar to FIG. 5, illustrates the bow in its fully drawn position with the upper bow limb occupying a bent position indicated as **8*c*. In the fully drawn position of FIG. 6, the force imposed on the bowstring 34 has decreased to a minimal value. By comparing FIG. 6 with FIG. 5, it will be observed that the upper draw pulley undergoes further rotation during movement of the upper pulley from its extended position 18*b* to its fully drawn position 18*c*. With the upper draw pulley in its fully drawn position 18*c*, the major line now occupies the position 33*c* in which the major line may be generally perpendicular to the long dimension of the upper limb in its position 8*c*. Through further rotation of the upper draw pulley from position 18*b* to position 18*c*, the mechanical advantage provided to the archer has been reduced since the larger line segment which was directed toward the end of the upper limb in position 35*b* is now directed away from the bow limb in position 35*c*. The effective length of the bow limb has, thus, been reduced during rotation of the upper draw pulley from extended position 18*b* to fully drawn position 18*c***.

Additionally, with the draw pulley in its fully drawn position **18*c*, the passage through the central portion of the pulley is now in a fully drawn position indicated as 42*c* in which the direction of the passage is in approximate alignment with the long dimension of the upper limb in its fully bent condition 8*c*. With the pulley in fully drawn position 18*c*, the draw cable in fully drawn condition 26*c* has been almost completely unwound from contact with the larger groove 454 (see FIG. 3). Any further location of the draw pulley in a clockwise direction from its fully drawn position 18*c* would, therefore, result in moving the line of force exerted by the draw cable 26*c* closer to the axis of the pivotal mounting 20*c*. As the line of direction of draw cable 26*c* approaches the axis of the pivotal mounting 20*c*, the torque which is applied to the upper draw pulley 8 is progressively reduced since the moment arm about the axis of pivotal mounting 20*c*** is progressively reduced.

In addition, any further clockwise rotation of the upper draw pulley beyond its position **18*c* would rotate the passage downwardly from its position 42*c* such that the passage would be angled inwardly toward the long dimension of the upper limb 8. This would result in changing the line of direction of the draw cable from its angled position shown as 26*c* with the result that the line of direction of the draw cable would then not be tangential to the surface of the upper pulley 18. This would cause a marked reduction in the rotational force applied to the upper pulley 18 since the force component applied tangentially to the surface of pulley 18** would be reduced as the angle of the line of pull with respect to the exterior surface of the upper pulley was increased.

By reason of the rotational position of the upper pulley in its fully drawn position **18*c* relative to the upper limb in fully bent position 8*c*, coupled with the angle between the draw pulley and the draw cable in its fully drawn position 26*c*, there is a very sharp increase in the force required to cause further clockwise rotation of the upper pulley beyond its position 18*c*. Thus, when the bow 2** is fully drawn, it is virtually impossible to draw the bow any further. This is in marked contrast to previous compound bows where the archer was able to continue draw of the bow beyond its fully drawn position with the result that the bow limbs could be inadvertently broken.

In the present bow construction, the draw which is applied during bending of the bow 2 decreases on rotation of the bow pulleys 18 and 22 to an extended condition as illustrated in FIG. 5. However, when the bow 2 is bent further to its fully drawn position illustrated in FIG. 6 and then is bent beyond this position, the feeling which may be experienced by the archer is analogous to the feeling of encountering a brick wall. At its fully drawn position, there is great resistance to any further draw of the bow. Thus, it is virtually impossible for an inexperienced archer to overdraw the bow 2 and to inadvertently break one of the bow limbs 8 or 10.

As described in regard to FIGS. 1–6, each of the draw pulleys 18 and 22 preferably includes two spaced peripheral grooves, one of which is larger, i.e., has a greater length, than the other groove. This is advantageous in providing a mechanical advantage in drawing of the bow that is proportional to the length of the larger groove with respect to the length of the smaller groove. However, the invention is not limited to the use of draw pulleys which have spaced peripheral grooves of unequal length.

Figure 7:
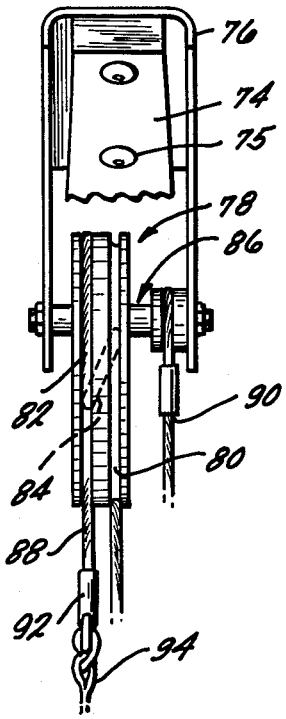
FIG. 7 is a partial end elevational view illustrating another embodiment of the invention in which first and second grooves in the draw pulleys are of equal length.

FIG. 7, which is a partial end elevational view, similar to FIG. 3, illustrates the use of draw pulleys having spaced grooves on the exterior surfaces of the draw pulleys which are of equal length. As shown, an upper limb 74 is connected to an upper support bracket 76 by an convenient means such as screws 75. A draw pulley 78 is eccentrically positioned for rotation relative to the upper bracket 76 with the pulley having a first groove 80 and a second groove 82. A passage 84 leads through the central portion of the pulley 78 to interconnect first groove 80 and second groove 82 with the pulley eccentrically supported by a pivotal mounting 86. A draw cable 88 passes into contact with the first groove 80, then through the passage 84 into contact with the second groove 82 in the manner described previously with regard to FIGS. 2 and 3 while a second draw cable 90 is secured to the pivotal mounting 86 and leads downwardly to a corresponding lower draw pulley (not shown) in a manner similar to that described in regard to FIGS. 3 and 4. The outer end of the draw pulley 88 is then connected to a bowstring holder 92 which is in turn connected to a bowstring 94.

The particular characteristics of a compound bow of the invention may be altered by varying the sizes of the draw pulleys which are employed and also the degree of eccentricity of pivotal mountings with respect to the draw pulleys, i.e., determined by the ratio of the length of the larger line segment with respect to the length of the smaller line segment as described in FIGS. 2, 5 and 6. Thus, bows may be provided which have varying degrees of letoff during rotation of the draw pulleys to an extended position as illustrated in FIG. 5 to effectively increase the length of the bow limbs. Also, if peripheral grooves of unequal length are provided on the draw pulleys, the length of the larger groove with respect to that of the shorter groove may be varied in altering the performance characteristics of the bow. In all of these variations, passages are provided through the central portions of the draw pulleys which interconnect the spaced grooves on the peripheral surfaces of the pulleys. With passages interconnecting the spaced grooves on the peripheral surfaces of the draw pulleys, the bow in its fully drawn position presents great resistance to any further bending of the bow limbs. This makes it almost impossible to overdraw the bow by an inexperienced archer to damage one of the bow limbs.

I claim:

1. In a compound bow having a center handle portion, upper and lower limbs having inner ends connected to the center portion and free outer ends, and upper and lower draw pulleys mounted respectively on the free outer ends of the upper and lower limbs, the improvement comprising:

each of said draw pulleys having a peripheral portion, a central portion extending diametrically through the center of the pulley, first and second spaced grooves in said peripheral portion, and a passage leading through said central portion and connecting said first and second grooves;

each pulley having an inner surface portion and an outer surface portion on said peripheral portion with the inner surface portion facing said bow with the bow in its rest position and the outer surface portion directed away from said bow with the bow in its rest position;

a pivotal mounting for each of said pulleys with the pulleys being eccentrically positioned for rotational movement with respect to said mountings during draw of the bow;

each of said mountings being positioned relative to one of the pulleys on a radial line passing through the approximate geometric center of the pulley with said mounting being disposed off-center on said radial line so that said line is divided into a shorter line segment and a longer line segment by the position of the mounting on said line;

a first draw cable having one end secured to the lower limb and a free end passing into contact with the inner surface portion of the first groove on the upper draw pulley with the bow in its rest position, then passing through the passage in the upper pulley into the second groove, and then passing over the inner surface portion of the second groove and into contact with the outer surface portion of the second groove;

a second draw cable having one end secured to the upper limb and a free end passing into contact with the inner surface portion of the first groove on the lower draw pulley with the bow in its rest position, then passing through the passage in the lower pulley into the second groove and then passing over the inner surface portion of the second groove and into contact with the outer surface portion of the second groove, and a bowstring interconnecting the free ends of the first and second draw cables, whereby with the bow in its rest position each of the draw pulleys are positioned with said longer line segment directed toward the inner end of the bow limb supporting the pulley and said shorter line segment directed toward the outer end of the bow limb supporting the pulley and with each of the pulleys undergoing rotation during draw of the bow to a position with said longer line segment directed toward the outer end of the bow limb supporting the pulley and said shorter line segment directed toward the inner end of the bow limb supporting the pulley with each of the bow limbs being effectively lengthened during draw of the bow.

2. The compound bow of claim 1 wherein each of said pulleys is annular, and the grooves on each of the pulleys have different diameters.

3. The compound bow of claim 2 wherein said second groove has a greater diametrical length than the diametrical length of said first groove to provide the archer with a mechanical advantage, in drawing the bow, that is proportional to the ratio of the diametrical length of the second groove with respect to the diametrical length of the first groove.

4. The compound bow of claim 2 wherein said passages pass through the approximate geometrical centers of said pulleys.

5. The compound bow of claim 2 wherein said passages are positioned at generally right angles with respect to said lines passing through said mountings and through the approximate geometrical centers of said pulleys.

6. The compound bow of claim 1 wherein said second groove has a greater diametrical length than said first groove to provide the archer with a mechanical advantage, in drawing the bow, that is proportional to the ratio of the diametrical length of the second groove with respect to the diametrical length of the first groove.

7. The compound bow of claim 1 wherein said passages pass through the approximate geometrical centers of said pulleys.

8. The compound bow of claim 1 wherein said passages are positioned at generally right angles with respect to said lines passing through said mountings and through the approximate geometrical centers of said pulleys.

9. The compound bow of claim 8 wherein said passages pass through the approximate geometrical centers of said pulleys.

10. In a compound bow having a center handle portion and upper and lower limbs having inner ends connected to the center handle portion and free outer ends, first and second draw pulleys each operatively coupled to an individual one of the associated limbs near the free end of an individual one of the limbs for rotation relative to the associated limb, means coupling the draw pulleys to the associated limbs in an eccentric relationship for rotation relative to the associated limbs about the coupling position as a fulcrum, a bow string, a pair of draw cables, means for coupling the bow string and the pair of draw cables to provide for a continuity between the bow string and the cables and to provide for a rotation of the pulleys in accordance with the tensioning of the bow string, and force-control means provided on the first and second draw pulleys for receiving the continuity provided by the bow string and the draw cables and for providing initially for a progressively increasing force on the bow string in accordance with an initial rotation of the pulleys, for providing subsequently for a progressively decreasing force on the draw cables in accordance with a further rotation of the pulleys and for providing for an increasing force on the draw cables at a very sharply increasing rate in accordance with a still further rotation of the pulleys.

11. In the compound bow set forth in claim 10, the force-control means provided on the first and second draw pulleys being constructed to provide for a disposition of the draw cables around the draw pulleys at a first radius along a first portion of the draw cables and to provide for a disposition of the draw cables around the draw pulleys at a second radius greater than the first radius along a second portion of the draw pulleys.

12. In the compound bow set forth in claim 10, the force-control means provided on each of the first and second draw pulleys being constructed to provide for the passage of the associated draw cables through the draw pulleys from one side of the draw pulleys to the opposite side of the draw pulleys to change from the disposition of the draw cables on the draw pulleys at the first radius at the position of rest of the bow string to the disposition of the draw cables on the draw pulleys at the second radius at the position of full draw of the bow string.

13. In the compound bow set forth in claim 10, the force-control means being constructed to position the draw pulleys for initially increasing the effective length of the limbs until an intermediate position in the draw of the bow string, thereafter to position the draw pulleys for decreasing the effective length of the limbs until the full draw position of the bow string and for subsequently positioning the draw pulleys after full draw of the bow string to decrease sharply the effective amount of the rotational force applied to the draw pulley from the force applied to the bow string.

14. In a compound bow a center handle portion having upper and lower ends, upper and lower limbs respectively attached to the upper and lower ends of the handle portions and having resilient properties, a bow string, a pair of draw cables, means for coupling the bow string and the draw cables to provide a continuity between the bow string and the draw cables, a pair of draw pulleys each receiving one of the draw cables and each operatively coupled to an individual one of the limbs at a position near the end of the associated limbs, means operatively coupled to the draw pulleys for mounting the draw pulleys at the outer ends of the upper and lower limbs at a position displaced from the center of the draw pulleys for providing a rotation of the draw pulleys about the position of mounting as a fulcrum in accordance with the draw of the bow string, and means included in the draw pulleys for retaining the draw cables against the draw pulleys to provide initially for an increase in the force imposed upon the bow string during an initial draw of the bow string, for a subsequent decrease in the force imposed upon the bow string during a further draw of the bow string and then for an increase at a very sharp rate in the force imposed upon the bow string during a still further draw of the bow string.

15. In the compound bow set forth in claim 1, the last mentioned means including means for providing for the passage of the draw cables through the draw pulleys diametrically from one side of the draw pulley to the other side of the draw pulley.

16. In the compound bow set forth in claim 15, first means on each of the draw pulleys for receiving the associated draw cable through a portion of a first periphery of the draw pulley, the first periphery of the draw pulley having a first diameter, and second means on each of the draw pulleys for receiving the draw cable through a portion of a second periphery of the draw pulley, the second periphery of the draw pulley having a second diameter which is less than the first diameter.

17. In the compound bow set forth in claim 15, the means for providing for the diametrical passage of the draw cable through the draw pulleys also providing for the transfer of the draw cables from the first means for receiving the draw cables on the first periphery to the second means for receiving the draw cable on the second periphery.

18. In the compound bow set forth in claim 17, the draw pulleys being mounted for rotation about an eccentric position defining a short line segment and a long line segment to opposite peripheries of the draw pulleys along a diameter extending through the mounting position and wherein the draw cable is disposed to provide the short line segment along the inner end of the draw cable and the long line segment along the outer end of the draw cable in the rest position of the draw cable and to provide the long line segment along the inner end of the draw cable and the short line segment along the outer end of the draw cable in the fully drawn position of the draw cable and wherein the passage of the draw cable through the draw cables is transverse to the diameter extending through the mounting position.

19. In the compound bow set forth in claim 18, the draw cable extending from the first periphery of the draw pulleys in a direction tangent to the pulleys in the fully drawn position of the draw cable and the tangential component decreasing with progressive increases in the draw of the bow string above the fully drawn position of the bow string to provide a sharp increase in the force required to pull the draw cable above the fully drawn position.

20. In a compound bow, a center handle portion, upper and lower limbs respectively attached to the upper and lower ends of the handle portions and having resilient properties, a bow string, a pair of draw cables, means for coupling the bow string and the draw cables to provide a continuity between the bow string and the draw cables, a pair of draw pulleys each constructed to receive an individual one of the draw cables and each operatively coupled to an individual one of the limbs at a position near the end of the associated limb, means for attaching the draw pulleys to the ends of the upper and lower limbs at a position offset from the center of the draw pulleys to provide for a rotation of the draw pulley in an eccentric relationship about the position of attachment as a fulcrum and to provide a short line segment and a long line segment from the offset position to opposite sides of the draw pulleys along a diameter extending through the offset position, and force-control means on the draw pulleys for providing for a disposition of the short line segment at the inner end of the pulleys and the long line segment at the outer end of the pulleys in the rest position of the draw cables to obtain the production of an increasing force on the draw cables upon the imposition of an initial tension of the bow string and the production of a decreasing force on the draw cables upon the imposition of a further tension on the bow string and for providing for a disposition of the short line segment at the outer end of the pulleys and the long line segment at the inner end of the pulleys in the fully drawn position of the draw cables to obtain the production of a very sharply increasing force on the draw cables upon the imposition of a still further tension on the bow string.

21. In a compound bow as set forth in claim 20, the force-control means on each of the draw pulleys including first and second peripheries having different diameters and spaced from each other to receive the draw cable and further including means for providing for the disposition of the associated draw cable on the draw pulley to extend around portions of the first and second peripheries of the draw pulley and the draw cables extending tangentially from the draw pulleys in the fully drawn position of the draw cables to provide for the imposition on the draw cables of progressively decreasing components of the force applied to the bow string.

22. In a compound bow as set forth in claim 21, the force-control means on each of the draw pulleys including a diametrical passage through the center of the draw pulley to provide for the passage of the associated draw cable between the first and second peripheries.

23. In a compound bow as set forth in claim 2, the diametrical passage in the force-control means being constructed to provide for the transfer of the draw cable from the first periphery of the draw cable to the second periphery of the draw cable and being disposed in transverse relationship to the diameter of the draw cables through the short line segment and the long line segment.

24. In a compound bow having a center handle portion and upper and lower limbs having inner ends connected to the center handle portion and free outer ends, first and second draw pulleys each disposed relative to the free end of an individual one of the limbs for rotation relative to the associated limb, means mounting the draw pulleys to the associated limbs in an eccentric relationship near the ends of the limbs for rotation relative to the associated limbs about the mounting position as a fulcrum to define a short line segment and a long line segment to opposite ends of the draw pulley through a diameter extending through the mounting means, a bow string, a pair of draw cables each extending around an associated one of the pulleys in a relationship to rotate the pulleys in accordance with the actuation of the bow string and to provide initially for a progressively increasing force in accordance with an initial rotation of the pulleys, to provide subsequently for a progressively decreasing force in accordance with further rotation of the pulley to the fully drawn position of the bow string and to provide for a very sharply increasing force in accordance with a still further rotation of the pulleys beyond the fully drawn position of the bow string, and means for coupling the bow string and the pair of draw cables to provide for a continuity between the bow string and the cables and to provide for a rotation of the pulleys in accordance with the tensioning of the bow string, each of the first and second draw pulleys being constructed to provide for the passage of the associated draw cable partially around the periphery of the draw pulley at one side of the draw pulley in transverse relationship to the short line segment and the long line segment and then through the draw pulley to the other side of the draw pulley and then around the periphery of the draw pulley at a position displaced from the passage of the associated draw cable partially around the periphery of the draw pulley.

25. In the compound bow set forth in claim 24, the short line segments and the long line segments being substantially parallel to the limbs in the rest and fully drawn positions of the bow string and the short line segment being at the outer end of the limbs in the rest position of the bow string and the long line segment being at the outer end of the limbs in the fully drawn position of the bow string.

26. In the compound bow set forth in claim 25, the bow string extending in tangential relationship from the draw pulleys in the fully drawn position of the bow string and extending from the draw pulleys with a progressively increasing component transverse to the tangential relationship with progressively increasing draws of the bow string beyond the fully drawn position to provide for the sharply increasing force on the bow string beyond the fully drawn position.

* * * * *